US006952845B1

(12) United States Patent
Akkad

(10) Patent No.: US 6,952,845 B1
(45) Date of Patent: Oct. 11, 2005

(54) COMBINED FABRIC WRAP AND CARRY BAG

(75) Inventor: Benjamin S. Akkad, Brooklyn, NY (US)

(73) Assignee: Idea Nuova, New York, NY (US)

( * ) Notice: Subject to any disclaimer, the term of this patent is extended or adjusted under 35 U.S.C. 154(b) by 0 days.

(21) Appl. No.: 10/632,367

(22) Filed: Aug. 1, 2003

Related U.S. Application Data

(60) Provisional application No. 60/400,814, filed on Aug. 2, 2002.

(51) Int. Cl.[7] ..... A47G 9/06
(52) U.S. Cl. ..... 5/419; 5/417; 5/485; 383/4
(58) Field of Search ..... 5/419, 417, 420, 5/485, 482; 383/4

(56) References Cited

U.S. PATENT DOCUMENTS

| | | | | | |
|---|---|---|---|---|---|
| 124,007 | A | * | 2/1872 | Nobles | 5/419 |
| 1,871,003 | A | * | 6/1932 | Longletz et al. | 5/490 |
| 1,930,942 | A | * | 10/1933 | Pringle | 5/419 |
| 2,045,784 | A | * | 6/1936 | Leve | 5/419 |
| 2,883,682 | A | * | 4/1959 | Kwake | 5/419 |
| 2,898,609 | A | * | 8/1959 | Storie | 5/419 |
| 3,689,947 | A | * | 9/1972 | Wolf | 5/419 |
| 4,375,111 | A | | 3/1983 | Hall | |
| 4,634,618 | A | * | 1/1987 | Greer et al. | 428/81 |
| 5,103,515 | A | | 4/1992 | Bird | |
| D341,513 | S | * | 11/1993 | Reeves et al. | D6/596 |
| 5,454,125 | A | * | 10/1995 | Ratkowski | 5/417 |
| 5,454,643 | A | * | 10/1995 | Sullivan | 383/4 |
| 5,457,829 | A | | 10/1995 | Elliott | |
| 5,463,783 | A | * | 11/1995 | Pope | 5/417 |
| 5,467,487 | A | * | 11/1995 | Sicard | 5/419 |
| 5,481,767 | A | * | 1/1996 | Lewis | 5/417 |
| 5,618,110 | A | * | 4/1997 | Sullivan | 383/4 |
| 5,629,071 | A | * | 5/1997 | Feldman | 428/192 |
| D388,273 | S | * | 12/1997 | Propper | D6/608 |
| 5,729,846 | A | * | 3/1998 | Sullivan | 5/419 |
| 5,774,912 | A | * | 7/1998 | Dominique | 5/419 |
| 5,920,931 | A | * | 7/1999 | Zuehlke et al. | 5/419 |
| 5,987,667 | A | * | 11/1999 | Haverly et al. | 5/485 |
| 6,105,188 | A | | 8/2000 | Perez-Mesa et al. | |
| 6,182,309 | B1 | * | 2/2001 | Sullivan | 5/419 |
| 6,192,536 | B1 | * | 2/2001 | Connors | 5/417 |
| 6,223,367 | B1 | * | 5/2001 | French et al. | 5/419 |
| 6,367,083 | B1 | | 4/2002 | November | |
| 6,393,638 | B1 | * | 5/2002 | MacColl | 5/419 |
| 6,408,462 | B1 | * | 6/2002 | Moore | 5/417 |

(Continued)

FOREIGN PATENT DOCUMENTS

| | | | | |
|---|---|---|---|---|
| FR | 002626152 | * | 7/1989 | 5/419 |

(Continued)

*Primary Examiner*—Robert G. Santos
(74) *Attorney, Agent, or Firm*—Akin Gump Strauss Hauer & Feld, LLP

(57) ABSTRACT

A combined fabric wrap and carry bag is disclosed. The combined fabric wrap and carry bag includes a first piece of fabric and a second piece of fabric affixed to the first piece of fabric to form a first pocket. In a first configuration, the second piece of fabric inverts inside-out relative to the first piece of fabric to form with a portion of the first piece of fabric a carry bag into which a remainder of the first piece of fabric may be inserted. In a second configuration, the first piece of fabric may be spread out on a supporting surface.

14 Claims, 8 Drawing Sheets

U.S. PATENT DOCUMENTS

| | | | | |
|---|---|---|---|---|
| 6,634,041 | B2 * | 10/2003 | Higashi et al. | 5/417 |
| 6,647,570 | B1 * | 11/2003 | Ong | 5/485 |
| 6,721,973 | B1 * | 4/2004 | Cristiano | 5/417 |
| 2004/0107500 | A1 * | 6/2004 | Pigg | 5/413 R |

FOREIGN PATENT DOCUMENTS

| | | | | |
|---|---|---|---|---|
| GB | 000369169 | * | 3/1932 | 5/485 |
| GB | 000398584 | * | 9/1933 | 5/419 |

* cited by examiner

COMBINED FABRIC WRAP AND CARRY BAG

CROSS-REFERENCE TO RELATED APPLICATIONS

This application claims benefit of U.S. Provisional Patent Application 60/400,814, "Combined Blanket and Stuff Shoulder Bag", filed Aug. 2, 2002.

BACKGROUND OF THE INVENTION

The present invention relates generally to fabric wraps and more particularly to a fabric wrap which forms its own carry bag to facilitate transport of the fabric wrap.

Blankets or mats which include their own storage system are known in the prior art. For example, U.S. Pat. No. 4,375,111 to Hall discloses a beach mat formed in combination with a carrying bag. The invention of Hall may be combined with a towel to provide a more comfortable lounging surface. In one embodiment of the Hall invention, a zippered carrying bag is formed integrally with the mat. U.S. Pat. No. 6,105,188 to Perez-Mesa et al. discloses a child's upper and lower blanket and pillow set with an integral nap-sack carrying pocket. The invention of Perez-Mesa et al. further includes fasteners to affix the upper and lower blankets together.

A deficiency of the prior art is that these devices comprise separate pieces, which tends to increase the bulk and weight of the device in its carrying pocket configuration. Additionally, particularly with respect to inventions which are directed to children, use of separate pieces increases the probability of a component being misplaced by the user.

BRIEF SUMMARY OF THE INVENTION

Briefly, the invention is a combined fabric wrap and carry bag comprising a first piece of fabric having at least a first corner. A separate second piece of fabric smaller than the first piece is overlapped on the first piece and affixed to the first piece on all but one free edge to form a first pocket having a mouth. At least one carrying strap having at least one end is affixed at least proximal the mouth. The second piece of fabric inverts inside-out relative to the first piece of fabric to form with at least a portion of the first corner of the first piece of fabric a carry bag into which a remainder of the first piece of fabric may be inserted.

In another aspect, the invention is a combined fabric wrap and carry bag comprising a first piece of fabric having at least a first corner. A separate second piece of fabric smaller than the first piece is overlapped on the first piece and affixed to the first piece on all but one free edge to form a pocket. At least one carrying strap having at least one end is affixed at least proximal an opening of the pocket. In a first configuration the second piece of fabric inverts inside-out relative to the first piece of fabric to form with at least a portion of the first corner of the first piece of fabric a carry bag into which a remainder of the first piece of fabric may be inserted. In a second configuration the first piece of fabric may be spread out on a supporting surface with the second piece of fabric overlapping only the first corner of the first piece of fabric.

In yet a third aspect, the invention is a combined fabric wrap and carry bag comprising a first piece of fabric having an outer perimeter. A separate second piece of fabric smaller than the first piece is overlapped on the first piece proximal to the outer perimeter and affixed to the first piece on all but one free edge to form a first pocket. At least a third piece of fabric smaller than the first piece is affixed to the first piece to form a second pocket. At least one carrying strap having at least one end is affixed at least proximal an opening of the first pocket. The second piece of fabric inverts inside-out relative to the first piece of fabric to form with a portion of the first corner of the first piece of fabric a carry bag into which a remainder of the first piece of fabric may be inserted.

In still yet a fourth aspect, the invention is a combined fabric wrap and carry bag comprising a first piece of fabric having an outer perimeter. A first pocket, smaller than the first piece of fabric, is affixed along an edge of the pocket to the outer perimeter so as to extend outwardly from the outer perimeter. At least one carrying strap having at least one end affixed at least proximal an opening of the first pocket is provided. The first pocket forms a carry bag into which the first piece of fabric may be inserted.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
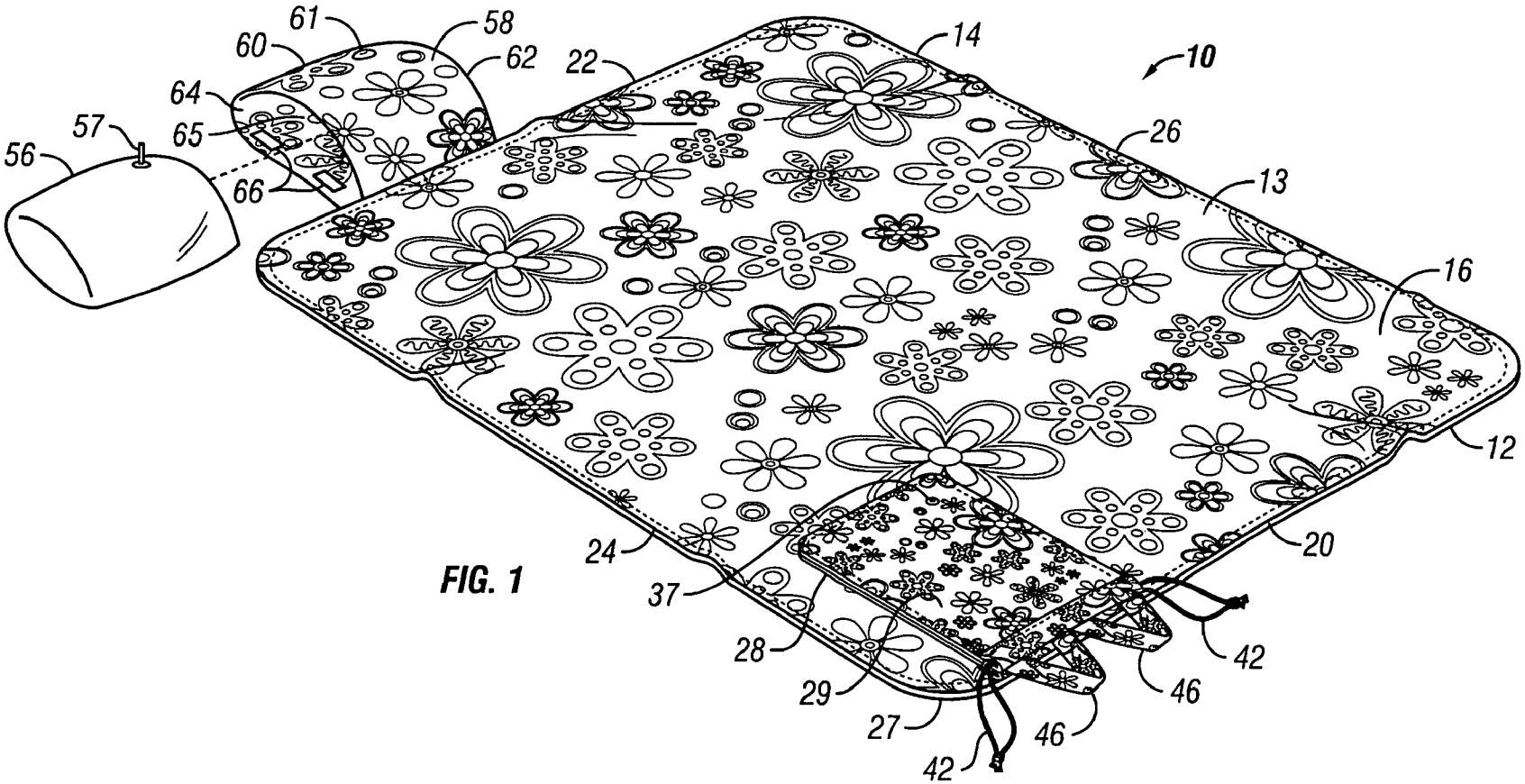
FIG. 1 is a top perspective view of a first side of a combined fabric wrap and carry bag in accordance with a first preferred embodiment of the present invention.

Certain terminology is used in the following description for convenience only and is not limiting. The words "right", "left", "top", and "bottom" designate directions in the drawings to which reference is made. The words "interior" and "exterior" refer to directions toward and away from, respectively, the geometric center of the combined fabric wrap and carry bag and designated parts thereof. The terminology includes the words above specifically mentioned, derivatives thereof and words of similar import.

As used herein, the word "wrap" refers to a sheet of fabric of a size and of a material suitable for use as a blanket, bath towel, or similar article.

A first preferred embodiment of the combined fabric wrap and carry bag of the present invention is shown in FIGS. 1–6 and is indicated generally at 10. The combined fabric wrap and carry bag 10 is comprised of a generally rectangular first piece of fabric 12. In this first preferred embodiment 10, the first piece of fabric 12 is a blanket 13, having a planar, spread-open configuration 14 (FIGS. 1–3) suitable for lounging activity, and a wrap configuration 15 (FIG. 6), appropriate for providing enhanced warmth while sleeping. The first piece of fabric 12 has a first side 16 exposed in FIGS. 1 and 2 and a second side 18 exposed in FIG. 3. The first piece of fabric 12 further includes a first edge 20, a second edge 22 opposing the first edge 20, a third edge 24 and a fourth edge 26 opposing the third edge 24. The edges 20, 22, 24 and 26 thus form an outer perimeter of the first piece of fabric 12, and are suitably hemmed to improve the durability of the first piece of fabric 12.

Figure 2:
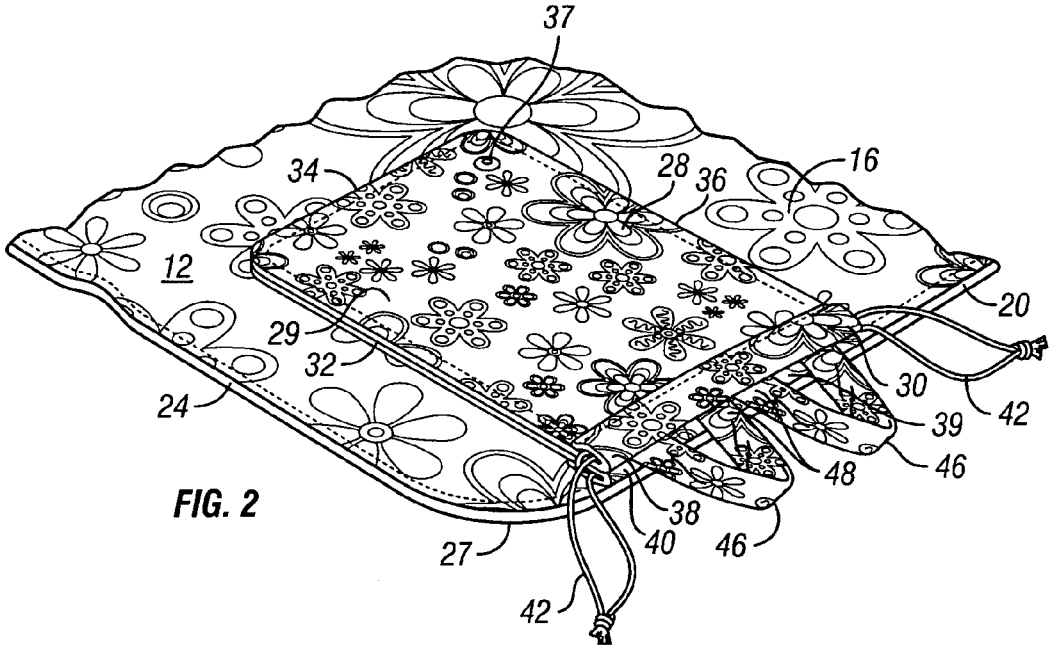
FIG. 2 is an enlarged sectional view of one corner of the combined fabric wrap and carry bag of FIG. 1.
Figure 3:
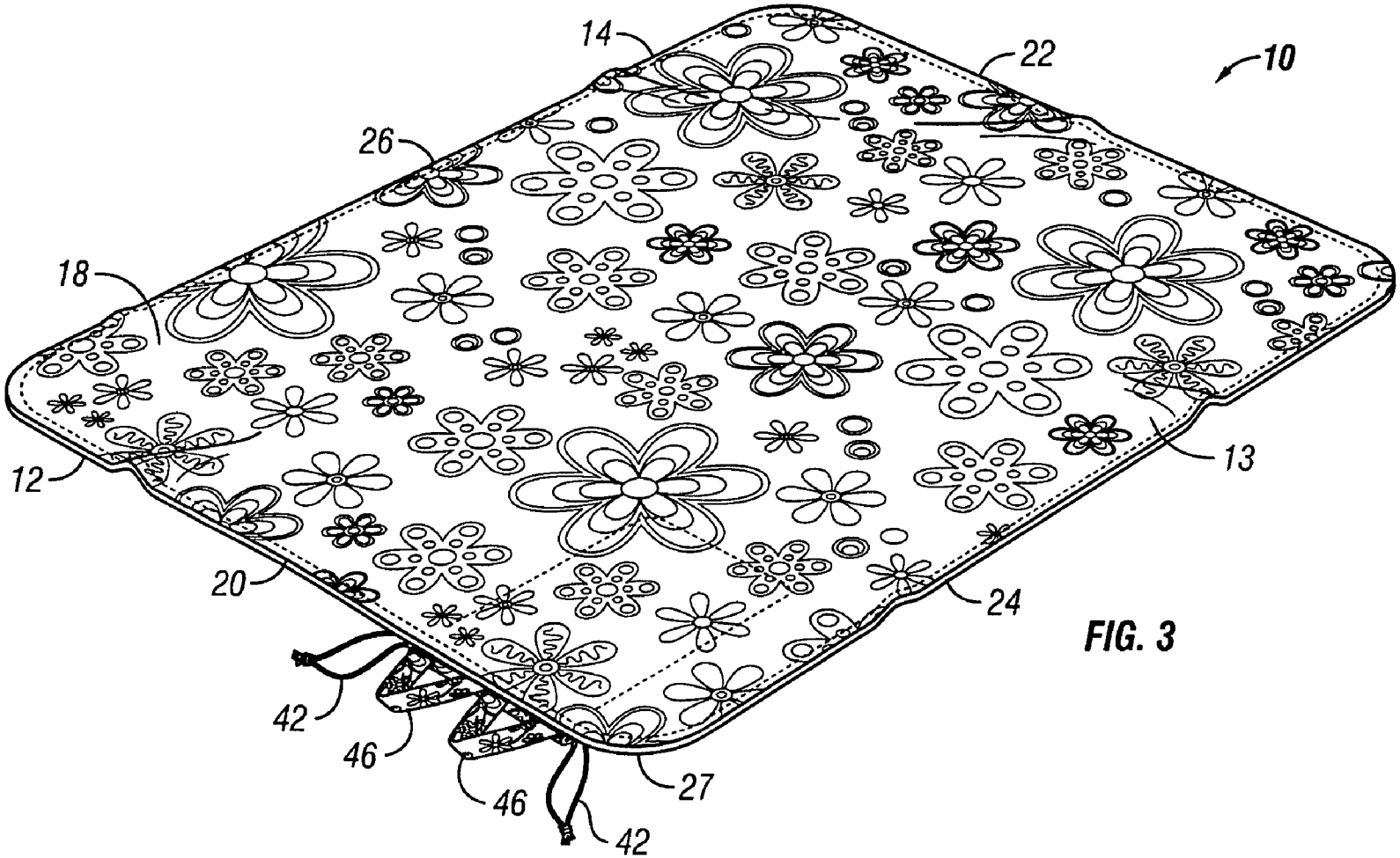
FIG. 3 is a top perspective view of a second side of the combined fabric wrap and carry bag of FIG. 1.

As seen particularly in FIG. 2, a first pocket 28 is provided by at least a separate second piece of fabric 29, preferably generally rectangular, affixed to the first edge 20 proximal a first corner 27 of the first piece of fabric 12. The first pocket 28 has first 30, second 32, third 34 and fourth 36 edges. The first pocket 28 is formed at least in part by sewing the second piece of fabric 29 to the first piece of fabric 12 along edges 32, 34 and 36 of the second piece of fabric 29. The first edge 30 is free and forms a mouth indicated generally at 39 in FIGS. 2 and 5. The first embodiment of the combined fabric wrap and carry bag 10 can be provided with a pillow 56, if desired which is adapted to be inserted within the first pocket 28. The first pocket 28 thus forms a pillowcase. The pillow 56 may be of a conventional or an inflatable type, the latter having a sealable valve stem 57 by which a user may inflate the pillow 56. If the pillow 56 is inflatable, the pillow 56 may be readily collapsed for easy transport. The second piece of fabric 29 may include an opening and grommet 37 through which the valve stem 57 may extend when the pillow 56 is inserted within the first pocket 28.

The first edge 30 is hemmed to create a first drawstring sleeve 38. A second drawstring sleeve 40 is also provided along a portion of the first edge 20 of the first piece of fabric 12 adjacent the first edge 30 of the first pocket 28. Lengths of a drawstring 42 are installed within the first and second drawstring sleeves 38 and 40 and joined together at opposing ends of the sleeve. A single drawstring passed through both sleeves might be used instead, as might several separate loops instead of the depicted sleeves 38, 40.

A second layer 44 of material may be sewn to the first piece of fabric 12 between the first piece of fabric 12 and the second piece of fabric 29. This second layer 44 can provide additional strength to the first pocket 28 and further can match the design of the inner side of the second piece of fabric 29 (as viewed in FIGS. 1 and 2) when the first pocket 28 is inverted, as will be described. This allows pieces of the same material to be printed on or otherwise decorated on only one side and still provide a wrap consistently decorated on its opposing sides and a carry bag with the same printing/decoration covering its entire outer side. Of course, the facing inner sides of the second layer 44 and second piece of fabric 29 of the device 10 as viewed in FIGS. 1 and 2, may be identical to one another and differ from any designs on either side of the first piece of fabric 12 and would be hidden from view inside pocket 28. At least one, and preferably a pair of carrying straps 46 are provided within the interior of the first pocket 28. The carrying straps 46 are preferably of a length suitable to fit around at least a child's shoulder, in the manner of a backpack strap. Thus, the carrying straps 46 are preferably at least a foot or more in length. The artisan will recognize that one or more handles preferably less than a foot in length could be substituted for the carrying straps 46 illustrated. The carrying straps 46 are preferably affixed at a first end 48 to one of the first piece of fabric 12, the second layer 44 and the second piece of fabric 29 proximal the one, free, first edge 30 of the second piece of fabric 29, more preferably to the second layer 44 near a midpoint of the first edge 30. The carrying straps 46 preferably are affixed at second opposite ends 50 proximal the opposing third edge 34, more preferably between the third edge 34 and the second layer 44 or, alternatively, to one of the two fabric pieces 12, 29 and the second layer 44.

Figure 4:
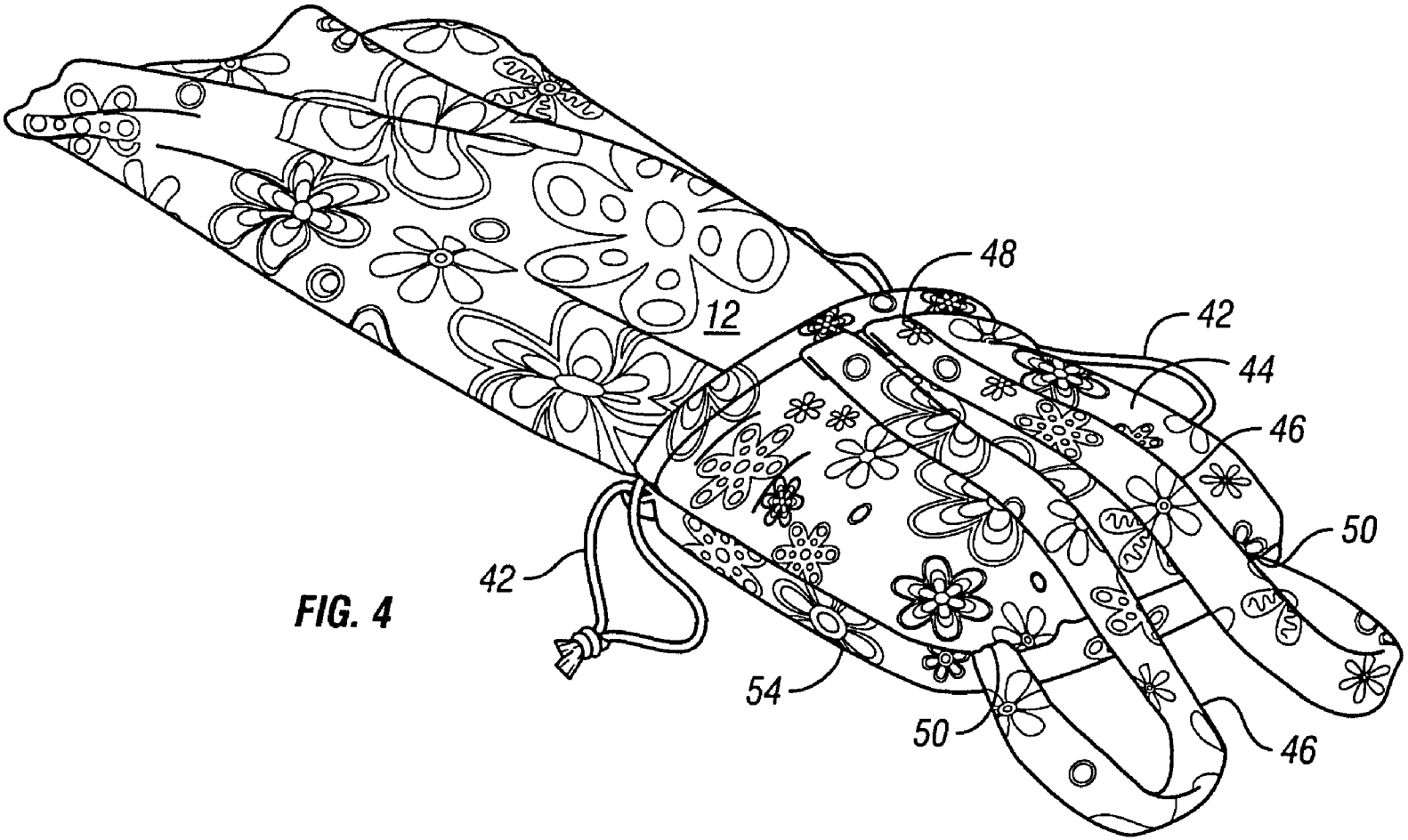
FIG. 4 is a top perspective view of the combined fabric wrap and carry bag of FIG. 1, showing a first pocket inverted relative to a first piece of fabric, with a remainder of the first piece of fabric ready to be stuffed within the first pocket.
Figure 5:
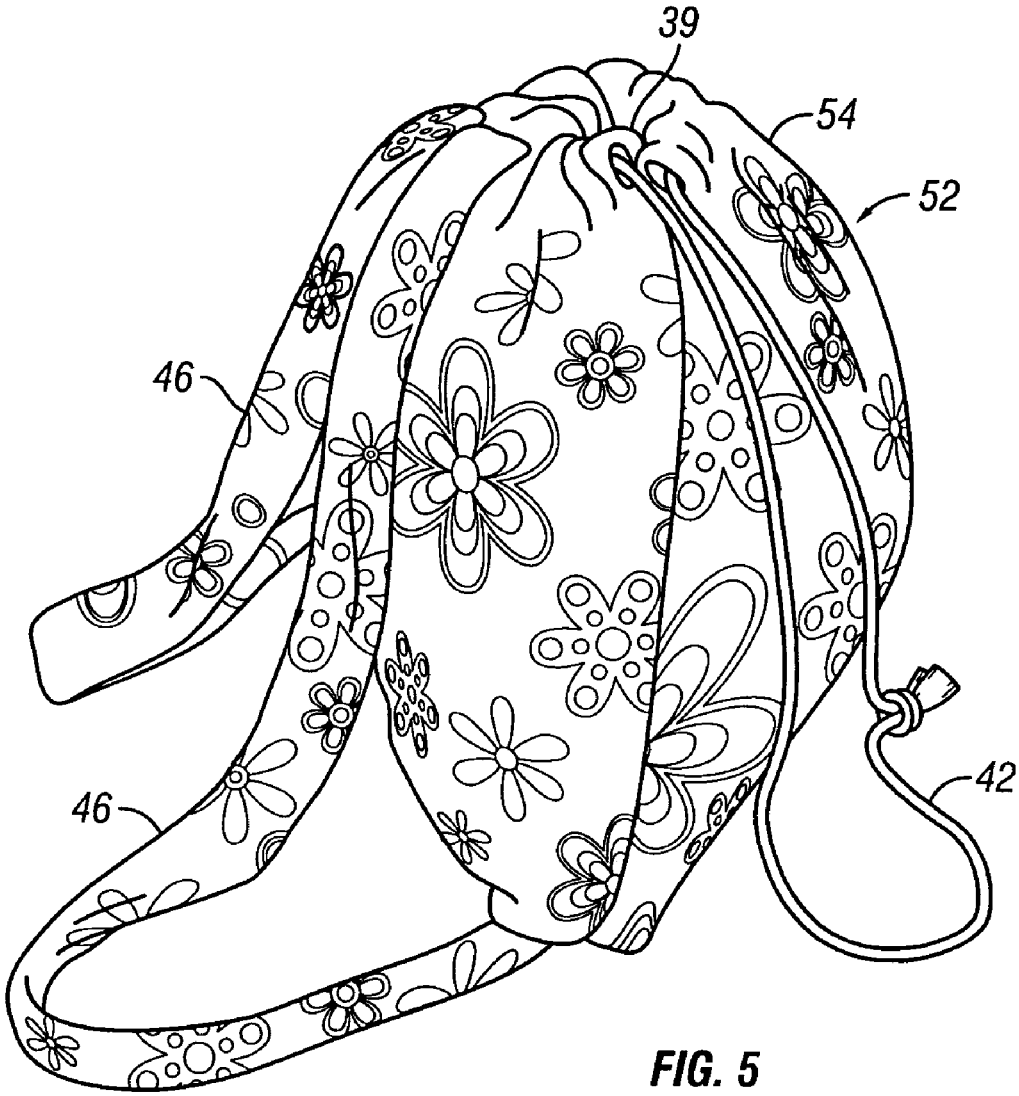
FIG. 5 is a side perspective view of the combined fabric wrap and carry bag of FIG. 1, shown in a carry bag configuration.

As illustrated in FIGS. 4 and 5, the first embodiment of the combined fabric wrap and carry bag 10 may be converted from the spread-open or wrap configurations 14, 15 into a carry bag configuration 52. FIG. 4 illustrates the second piece of fabric 29 having been inverted inside-out relative to the first piece of fabric 12. A remainder of the first piece of fabric 12 is ready to be stuffed into a carry bag 54 thus formed. FIG. 5 illustrates the remainder of the first piece of fabric having been fully inserted into the carry bag 54, and the drawstring 42 pulled to close the mouth 39 of the carry bag 54.

As illustrated in FIG. 1, an optional second pocket 60 may be provided by at least a third piece of fabric 58. The generally rectangular third piece of fabric 58 is preferably folded such that opposing first and second edges meet, with both the first and second edges being affixed to the first piece of fabric 12 proximate the second edge 22 opposite the first edge 20 so that the second pocket 60 projects outwardly from the first piece of fabric 12. A first end 62 of the second pocket 60 is preferably sewn closed, while a second end 64 of the second pocket 60 has a mouth 65, but provided with a closure 66 such as buttons, a zipper, hook and loop fabric fasteners (i.e. VELCRO®) or other releasable closure(s). The second pocket 60 thus may act as a second pillowcase, and is adapted to receive the pillow 56. The second pocket 60 may further include an opening and grommet 61 through which the inflatable pillow valve stem 57 may extend when such pillow 56 is inserted within the second pocket 60. The artisan will recognize that the second pocket 60 could be formed using multiple pieces of material rather than the folded single third piece of material 58 and further that the pocket opening may be along the second edge 22.

Figure 7:
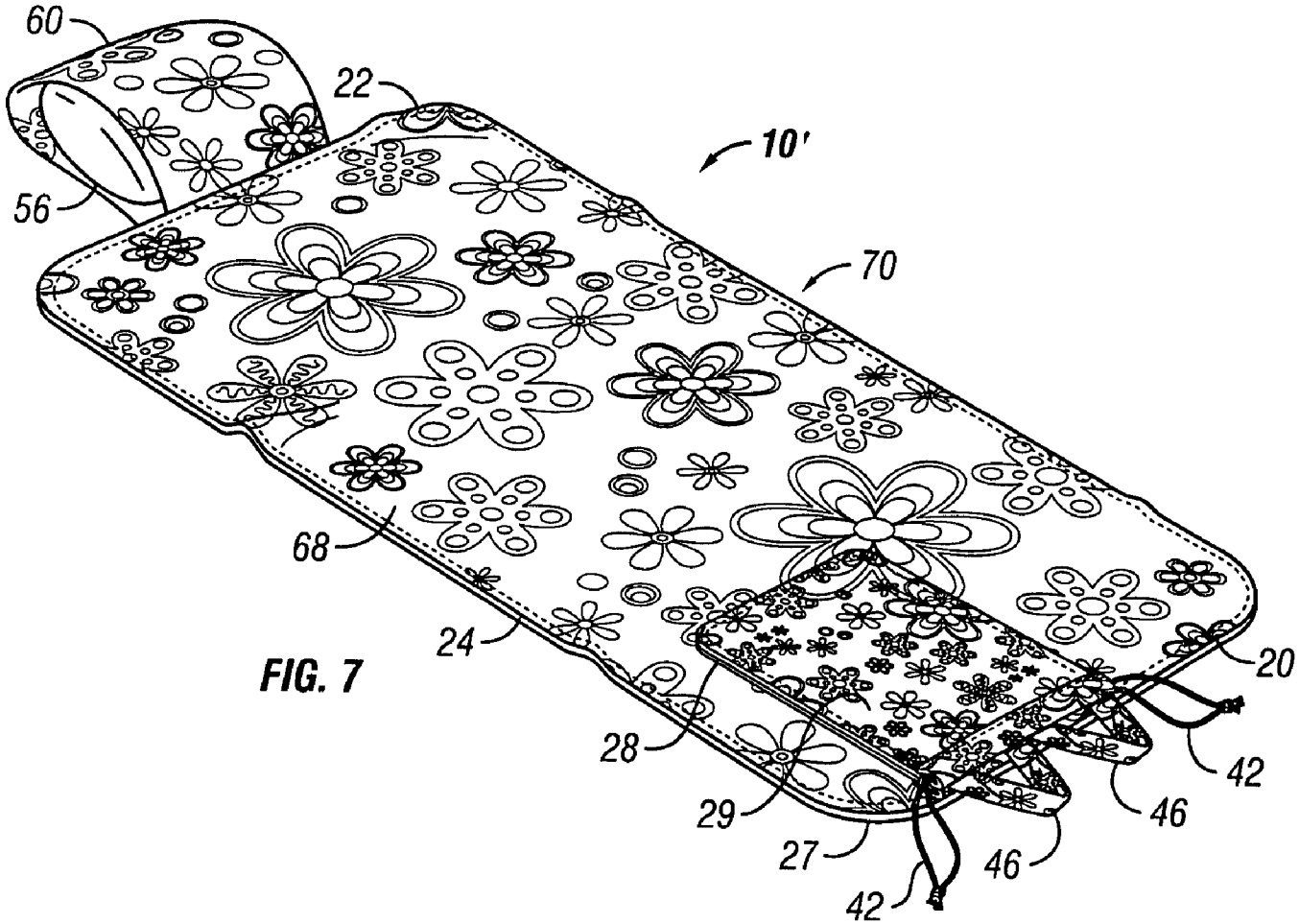
FIG. 7 is a top perspective view of a combined fabric wrap and carry bag in accordance with a second preferred embodiment of the present invention.

A second preferred embodiment of the combined fabric wrap and carry bag of the present invention is shown in FIG. 7 and is indicated generally at 10'. The second preferred embodiment 10' differs from the first preferred embodiment 10 in that the second preferred embodiment 10' is more narrow (for example, less than three feet wide), and thus is not adapted to fully cover someone when folded over that person in the wrap configuration 15. The second preferred embodiment 10' is well-suited for use as a beach towel 68. FIG. 7 shows the beach towel 68 spread out in a lounging configuration 70. The second preferred embodiment 10' is otherwise similar to the first preferred embodiment 10.

In the first preferred embodiment 10, the first piece of fabric 12, the first pocket 28, the second layer of material 44, the third piece of fabric 58 and the carrying straps 46 are all preferably fabricated from a suitably soft, warm and readily washable material, such as cotton, while the drawstring 42 is made from nylon cord. Other materials, for example wool, POLARTEC® fleece, CORDURA® nylon, SUPPLEX® nylon or Polyester POLARFLEECE®, could be substituted for some or all of these components. Furthermore, the size and shape of the various components could be modified. To fold the first piece 12 over upon a person using it as a wrap to fully cover or at least nearly fully cover someone, the width is suggestedly about four feet or more.

In the second preferred embodiment 10', in addition to being soft and readily washable, the material used for the first piece of fabric 12, second piece of fabric 29, second layer of material 44, third piece of fabric 58 and carrying straps 46 should also be absorbent. Cotton and cotton blends, for example in a terry or other traditional towel weave, are the preferred materials of construction.

Figure 8:
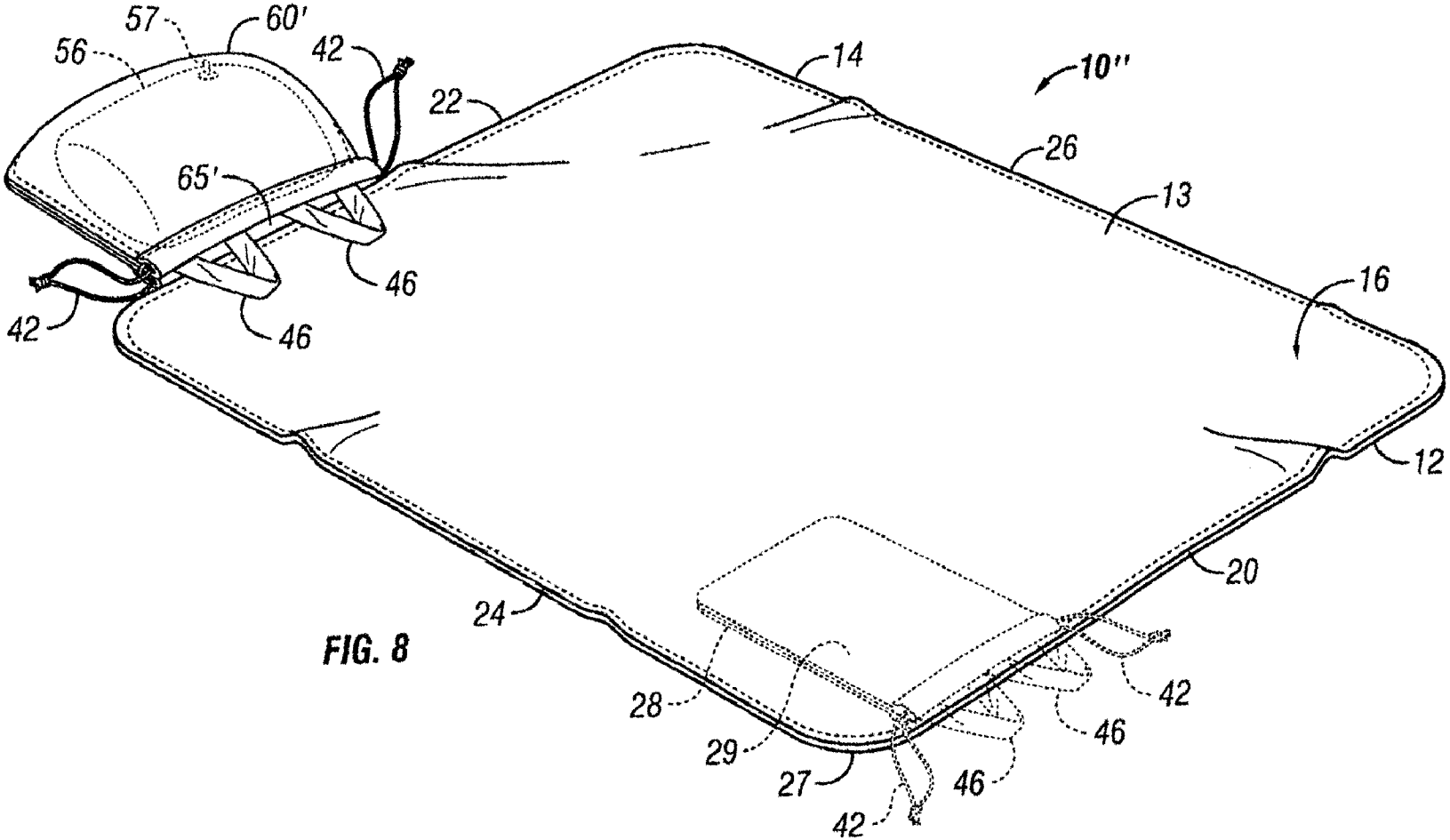
FIG. 8 is a top perspective view of a combined fabric wrap and carry bag in accordance with a third preferred embodiment of the present invention.

A third preferred embodiment of the combined fabric wrap and carry bag of the present invention is shown in FIG. 8 and is indicated generally at 10. The third preferred embodiment 10" differs from the first preferred embodiment 10 in that a second embodiment 60' of the second pocket 60 is provided, and the first pocket 28 formed on the first piece of fabric 12 is optional and may be eliminated. As illustrated one or a pair of carry straps 46 and/or draw string 42 or other closure are included in the second pocket second embodiment 60'. FIG. 8 further illustrates that the mouth could be moved to the second edge 22 adjacent the second pocket 60 to form a second embodiment mouth 65'. The shoulder straps 46 are extended from proximal the second embodiment mouth 65' into the interior of the second pocket second embodiment 60' and away from second edge 22 and second embodiment mouth 65'. In this way, the second pocket second embodiment 60' can serve as both a carry bag and a pillow case. The artisan will recognize that both the first pocket 28 and the second pocket second embodiment 60' could be provided, giving the user a choice of two carry pockets. The third preferred embodiment 10" is otherwise similar to the first preferred embodiment 10. The artisan will recognize that features of the third preferred embodiment 10" could be incorporated into the second preferred embodiment 10'.

Figure 6:
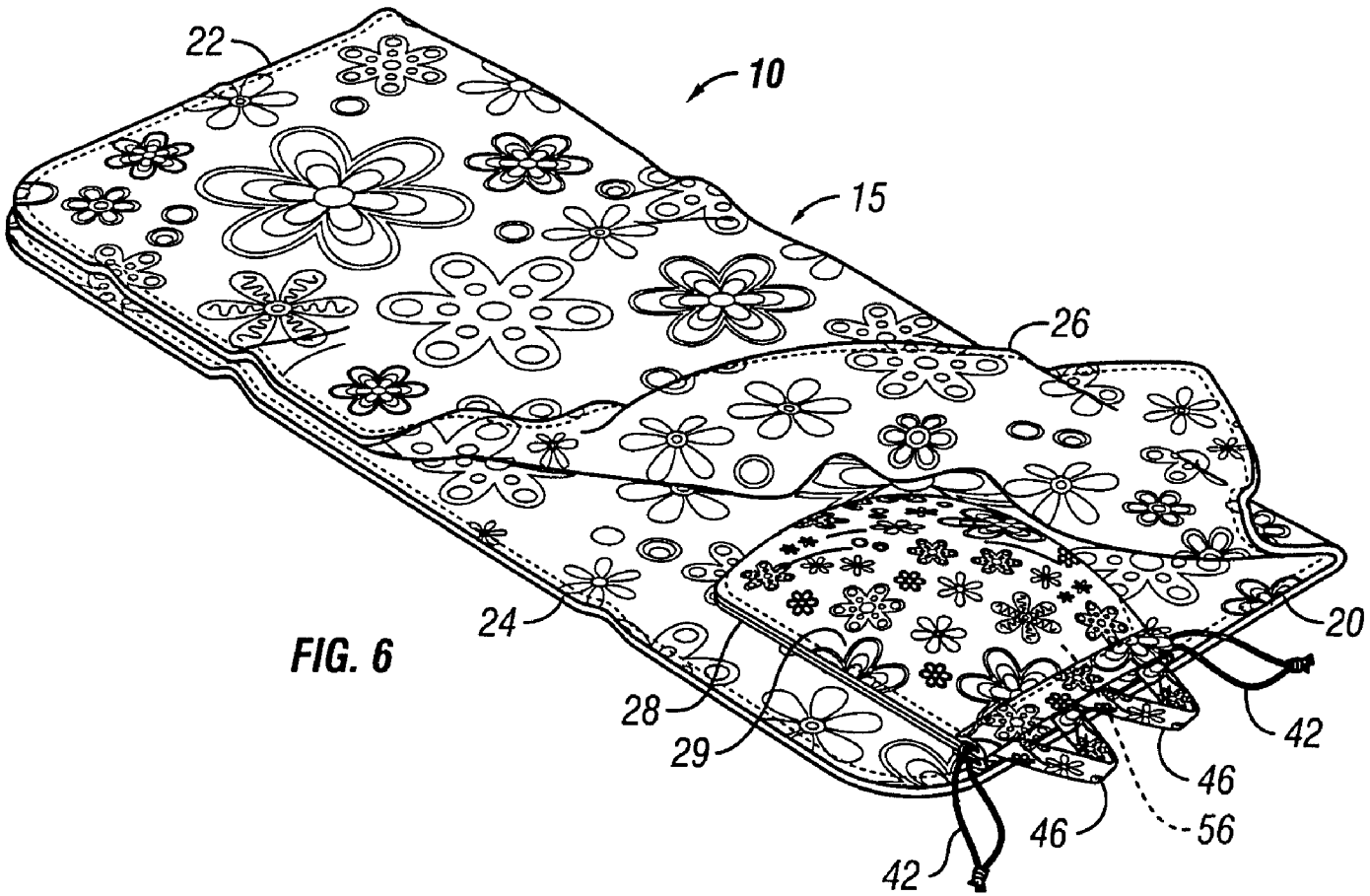
FIG. 6 is a top perspective view of the combined fabric wrap and carry bag of FIG. 1, shown with a pillow inserted into the first pocket and an edge of the first piece of fabric folded in a manner that would cover a user's body.

In use, the invention is particularly attractive to children, but is not limited to them. A child user, equipped with the combined fabric wrap and carry bag 10, 10' or 10" may embark on a journey, real or imagined. With the combined fabric wrap and carry bag 10, 10', 10" in the carry bag configuration 52 (see FIG. 5), the child will feel as though he or she has a packed bag, emulating an adult's suitcase or sleeping bag. When ready for rest, the child will loosen the drawstring 42 or other closure, exposing the first piece of fabric 12. The first piece of fabric 12 is unpacked from the carry bag 52 The first piece of fabric 12 is spread out on a suitable sleeping or lounging surface. The inventions could be provided in a range of sizes suitable for adults and children. The pillow 56 or other cushioning material (not shown) may be inserted within the now empty first pocket 28, second pocket 60 or second pocket second embodiment 60'. If using the first or third preferred embodiments 10 or 10", the child may then wrap the edge 26 over him or her self for warmth, as indicated in FIG. 6, in the wrap configuration 15. If using the second preferred embodiment 10', the child will use the beach towel 68 in the lounging configuration 70. After use, the combined fabric wrap and carry bag 10, 10' or 10" may be converted back to the carry bag configuration 52 as described above. Of course each embodiment can be proportioned for use by adults (as well as children) who would enjoy the same practical benefits.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A combined fabric wrap and carry bag comprising:

a first piece of fabric having at least a first corner;

a separate second piece of fabric smaller than the first piece, overlapped on the first piece and affixed to the first piece on all but one free edge to form a first pocket having a mouth; and, at least one carrying strap having at least one end affixed at least proximal the mouth, whereby the second piece of fabric inverts inside-out relative to the first piece of fabric to form with at least a portion of the first corner of the first piece of fabric a carry bag into which a remainder of the first piece of fabric may be inserted;

wherein a second end of the at least one carrying strap is captured between the first piece of fabric and the second piece of fabric; and wherein the at least one carrying strap is at least a foot long and only partially protrudes from the pocket without the second piece of fabric being inverted.

2. The combined fabric wrap and carry bag of claim 1, wherein the second end of the at least one carrying strap is captured inside the mouth.

3. A combined fabric wrap and carry bag comprising:

a first piece of fabric having at least a first corner;

a separate second piece of fabric smaller than the first piece, overlapped on the first piece and affixed to the first piece on all but one free edge to form a first pocket having a mouth;

at least one carrying strap having at least one end affixed at least proximal the mouth;

a second carrying strap affixed at a first end to the one of the first piece of fabric and second piece of fabric proximal the free edge of the second piece of fabric and at a second end between the first piece of fabric and the second piece of fabric where the first piece of fabric and the second piece of fabric are irremovably secured together;

whereby the second piece of fabric inverts inside-out relative to the first piece of fabric to form with at least a portion of the first corner of the first piece of fabric a carry bag into which a remainder of the first piece of fabric may be inserted; and wherein the at least one carrying strap is at least a foot long and only partially protrudes from the pocket without the second piece of fabric being inverted.

4. A combined fabric wrap and carry bag comprising:

a first piece of fabric having at least a first corner;

a separate second piece of fabric smaller than the first piece, overlapped on the first piece and affixed to the first piece on all but one free edge to form a first pocket having a mouth; and, at least one carrying strap having at least one end affixed at least proximal the mouth, whereby the second piece of fabric inverts inside-out relative to the first piece of fabric to form with at least a portion of the first corner of the first piece of fabric a carry bag into which a remainder of the first piece of fabric may be inserted, wherein a second end of the at least one carrying strap is captured between the first piece of fabric and the second piece of fabric;

wherein the second end of the at least one carrying strap is captured inside the carry bag where the first piece of fabric and the second piece of fabric are immovably secured together; and wherein the at least one carrying strap is at least a foot long and only partially protrudes from the pocket without the second piece of fabric being inverted.

5. A combined fabric wrap and carry bag comprising:

a first piece of fabric having at least a first corner;

a separate second piece of fabric smaller than the first piece, overlapped on the first piece and affixed to the first piece on all but one free edge to form a first pocket having a mouth;

at least one carrying strap having at least one end affixed at least proximal the mouth; and a second pocket attached to the first piece proximate a second free edge of the first piece, the second free edge being opposite a first free edge of the first piece proximate the first free edge of the second piece where the first piece of fabric and the second piece of fabric are irremovably secured together;

whereby the second piece of fabric inverts inside-out relative to the first piece of fabric to form with at least a portion of the first corner of the first piece of fabric a carry bag into which a remainder of the first piece of fabric may be inserted; and wherein the at least one carrying strap is at least a foot long and only partially protrudes from the pocket without the second piece of fabric being inverted.

6. The combined fabric wrap and carry bag of claim 5, wherein the second pocket extends away from the first piece of fabric and the second free edge.

7. The combined fabric wrap and carrying bag of claim 6, in combination with an inflatable pillow sized to fit completely into the second pocket.

8. A combined fabric wrap and carry bag comprising:

a first piece of fabric having an outer perimeter;

a first pocket smaller than the first piece of fabric, affixed along an edge of the pocket to the outer perimeter so as to extend outwardly from the outer perimeter;

at least one carrying strap having at least one end affixed at least proximal an opening of the first pocket; and a separate second piece of fabric smaller than the first piece, overlapped on the first piece proximal to the outer perimeter and affixed to the first piece on all but one free edge to form a second pocket;

whereby the first pocket forms a carry bag into which the first piece of fabric may be inserted;

whereby the second piece of fabric inverts inside-out relative to the first piece of fabric to form with a portion of the first corner of the first piece of fabric a second carry bag into which the first pocket and a remainder of the first piece of fabric may be inserted; and wherein the at least one carrying strap is a shoulder strap at least a foot long and only partially protrudes from the pocket without the second piece of fabric being inverted, the at least one shoulder strap having a second end captured between the first piece of fabric and the pocket where the first piece of fabric and the pocket are irremovably secured together opposite an open mouth of the pocket.

9. The combined fabric wrap and carry bag of claim 8, wherein the first pocket includes a closure.

10. The combined fabric wrap and carry bag of claim 9, wherein the first pocket closure includes a drawstring.

11. The combined fabric wrap and carry bag of claim 8, wherein the first pocket has at least one end secured to the first piece proximal the outer perimeter so as to extend outwardly from the outer perimeter.

12. The combined fabric wrap and carry bag of claim 11, wherein the first pocket has a mouth on a side of the pocket other than at the one end secured to the first piece.

13. The combined fabric wrap and carry bag of claim 8, wherein the first piece of fabric is generally rectangular with four side edges and wherein the first pocket and the second piece of fabric are proximal different side edges.

14. The combined fabric wrap and carry bag of claim 8, wherein the first pocket and the second piece of fabric are located proximal opposite side edges of the first piece of fabric.

* * * * *